US010012029B2

(12) United States Patent
Poteet, III

(10) Patent No.: US 10,012,029 B2
(45) Date of Patent: Jul. 3, 2018

(54) ROLLING CONES WITH GAGE CUTTING ELEMENTS, EARTH-BORING TOOLS CARRYING ROLLING CONES WITH GAGE CUTTING ELEMENTS AND RELATED METHODS

(71) Applicant: Baker Hughes Incorporated, Houston, TX (US)

(72) Inventor: Carl E. Poteet, III, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 263 days.

(21) Appl. No.: 14/975,011

(22) Filed: Dec. 18, 2015

(65) Prior Publication Data

US 2017/0175450 A1 Jun. 22, 2017

(51) Int. Cl.
*E21B 10/50* (2006.01)
*E21B 10/14* (2006.01)

(52) U.S. Cl.
CPC ..... *E21B 10/50* (2013.01); *E21B 10/14* (2013.01)

(58) Field of Classification Search
CPC ..... E21B 10/14; E21B 10/50
See application file for complete search history.

(56) References Cited

U.S. PATENT DOCUMENTS 930,759 A 8/1909 Hughes
5,346,026 A * 9/1994 Pessier ..... E21B 10/16 175/331
5,890,552 A * 4/1999 Scott ..... E21B 10/50 175/426
5,979,575 A * 11/1999 Overstreet ..... E21B 10/50 175/341
6,202,770 B1 3/2001 Jurewicz et al.
6,390,210 B1 * 5/2002 Portwood ..... E21B 10/16 175/331
8,678,111 B2 3/2014 Zahradnik et al.
9,004,198 B2 4/2015 Kulkarni
2005/0051361 A1 * 3/2005 Singh ..... E21B 10/08 175/40

(Continued)

OTHER PUBLICATIONS

Pessier et al., Rolling Cone Bits with Novel Gauge Cutting Structure Drill Faster, More Efficiently, Society of Petroleum Engineers, Inc., SPE Annual Technical Conference & Exhibition, Oct. 22-25, 1995, SPE 30473, pp. 241-250.

*Primary Examiner* — James G Sayre
(74) *Attorney, Agent, or Firm* — TraskBritt

(57) ABSTRACT

A rolling cone for use on an earth-boring tool includes a frustoconical surface at a proximal end of the rolling cone and an outer surface located distally of the frustoconical surface. The outer surface has a circumferential land surface adjacent the frustoconical surface. The rolling cone includes at least one gage cutting element affixed to the circumferential land surface. A portion of the at least one gage cutting element extends into the frustoconical surface. The at least one gage cutting element includes a volume of superabrasive material disposed on a substrate. A flat surface of the volume of superabrasive material intersects a front cutting face of the volume of superabrasive material. The flat surface is oriented at an acute angle relative to the front cutting face and is located on a side of the at least one gage cutting element that extends into the frustoconical surface of the rolling cone.

20 Claims, 5 Drawing Sheets

(56) References Cited

U.S. PATENT DOCUMENTS

2008/0156542 A1* 7/2008 Baker ..... E21B 10/16
175/331
2013/0313021 A1 11/2013 Zahradnik et al.

* cited by examiner

ROLLING CONES WITH GAGE CUTTING ELEMENTS, EARTH-BORING TOOLS CARRYING ROLLING CONES WITH GAGE CUTTING ELEMENTS AND RELATED METHODS

TECHNICAL FIELD

Embodiments of the present disclosure relate to rolling cone cutters for earth-boring tools and, more specifically, to rolling cone cutters having gage cutting elements on a heel land adjacent a frustoconical gage surface of the rolling cone cutter.

BACKGROUND

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field near Beaumont, Tex., with relative ease. That venerable invention, within the first decade of the last century, could drill a scant fraction of the depth and speed of the modern rotary rock bit. The original Hughes bit drilled for hours; the modern bit now drills for days. Modern bits sometimes drill for thousands of feet instead of merely a few feet. Many advances have contributed to the impressive improvements in rotary rock bits.

In drilling wellbores in earthen formations using rolling-cone bits, which may also be characterized as "rock bits," such bits having one or more rolling cones rotatably mounted thereon are employed. The term "cone" is a term of art, as other shapes of rolling structures used in drilling subterranean formations are conventional. The bit is secured to the lower end of a drill string that is rotated from the surface or by downhole motors or turbines. The cones are rotationally mounted on legs of the bit roll and slide upon the bottom of the wellbore as the drill string is rotated, to engage and disintegrate the formation material to be removed. The rolling cones are provided with cutting elements or teeth, which may be integral with the cones or inserts secured to the cones, that are forced to penetrate and gouge the bottom of the wellbore by weight from the drill string. Other, so-called "hybrid," drill bits employ rolling cones in combination with fixed cutters mounted on blades extending from the drill bit body. The formation cuttings from the bottom and sides (i.e., the wall) of the wellbore are washed away and disposed by drilling fluid that is pumped down from the surface through the hollow, rotating drill string, and the nozzles as orifices on the drill bit. Eventually the cuttings are carried in suspension in the drilling fluid to the surface up the exterior of the drill string in the wellbore annulus.

BRIEF SUMMARY

In one embodiment of the disclosure, an earth-boring tool includes a bit body and at least one rolling cone rotatably attached to a leg of the bit body. The at least one rolling cone includes a frustoconical surface proximate the leg and an outer surface located distally of the frustoconical surface. The outer surface includes a circumferential land surface adjacent the frustoconical surface and a plurality of cutting inserts and at least one gage cutting element affixed to the circumferential land surface. A portion of the at least one gage cutting element extends into the frustoconical surface, the at least one gage cutting element includes a volume of superabrasive material disposed on a substrate. A flat surface of the volume of superabrasive material intersects a front cutting face of the volume of superabrasive material. The flat surface is oriented at an acute angle relative to the front cutting face and is located on a side of the at least one gage cutting element extending into the frustoconical surface of the at least one rolling cone.

In another embodiment of the disclosure, a rolling cone for use on an earth-boring tool includes a frustoconical surface at a proximal end of the rolling cone and an outer surface located distally of the frustoconical surface. The outer surface has a circumferential land surface adjacent the frustoconical surface. The rolling cone includes at least one gage cutting element affixed to the circumferential land surface. A portion of the at least one gage cutting element extends into the frustoconical surface. The at least one gage cutting element includes a volume of superabrasive material disposed on a substrate. A flat surface of the volume of superabrasive material intersects a central, planar surface of a front cutting face of the volume of superabrasive material. The flat surface is oriented at an acute angle relative to the central, planar surface and is located on a side of the at least one gage cutting element that extends into the frustoconical surface of the rolling cone.

In yet another embodiment of the disclosure, a method of assembling an earth-boring tool includes affixing a rolling cone to a leg of a bit body of the earth-boring tool. The at least one rolling cone includes a frustoconical surface proximate the leg and an outer surface located distally of the frustoconical surface. The outer surface includes a circumferential land surface adjacent the frustoconical surface and a plurality of cutting inserts affixed to the circumferential land surface. At least one gage cutting element is also affixed to the circumferential land surface. A portion of the at least one gage cutting element extends into the frustoconical surface. The gage cutting element includes a volume of superabrasive material disposed on a substrate. A flat surface of the volume of superabrasive material is contiguous with a front cutting face of the volume of superabrasive material. The flat surface is oriented at an acute angle relative to the front cutting face and the flat surface is located on a side of the at least one gage cutting element that extends into the frustoconical surface of the at least one rolling cone.

BRIEF DESCRIPTION OF THE DRAWINGS

While the specification concludes with claims particularly pointing out and distinctly claiming what are regarded as embodiments of the present disclosure, various features and advantages of the disclosed embodiments may be more readily ascertained from the following description when read with reference to the accompanying drawings, in which:

DETAILED DESCRIPTION

The illustrations presented herein are not actual views of any earth-boring tool, bit, rolling cone, cutting insert, or gage cutting element, but are merely idealized representations employed to describe embodiments of the present disclosure. Additionally, elements common between figures may retain the same numerical designation.

Any headings used herein should not be considered to limit the scope of embodiments of the present disclosure as defined by the appended claims and their legal equivalents. Concepts described in any specific headings are generally applicable in other sections throughout the entire specification.

When used herein in reference to a component configured to be located in a wellbore, the terms "above," "up," "upper," "upward" and "uphole" mean and include a relative position proximate the terranean origin of the well, whereas the terms "below," "lower," "down," "downward," "downhole" and "bottom" mean and include a relative position distal the terranean origin of the well.

As used herein, the term "longitudinal" refers to a direction parallel to a longitudinal axis of a downhole tool or a longitudinal axis of a component thereof.

As used herein, the term "lateral" refers to a direction orthogonal to a longitudinal axis of a downhole tool or a longitudinal axis of a component thereof.

Figure 1:
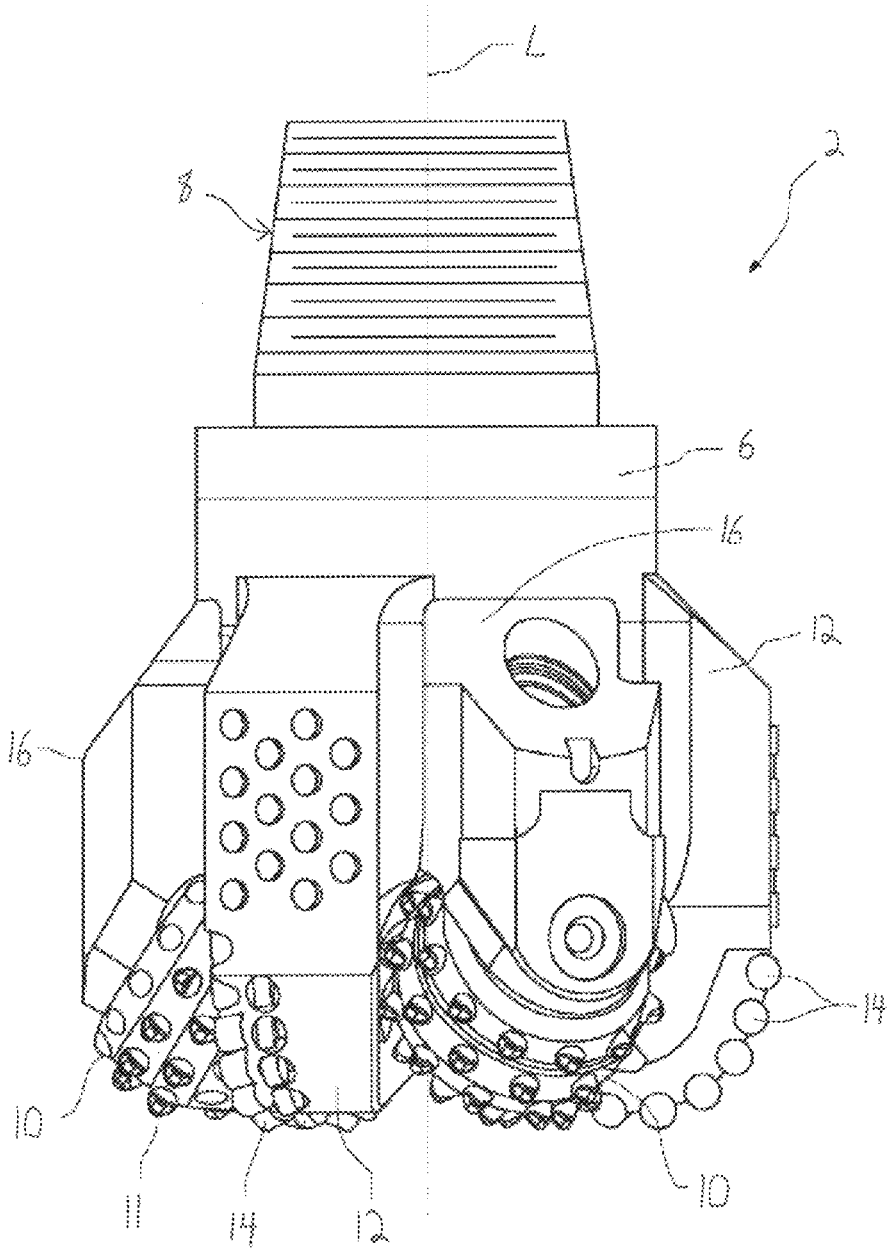
FIG. 1 illustrates a side view of an earth-boring tool employing rolling cones, according to an embodiment of the present disclosure.

FIG. 1 illustrates an earth-boring tool in the form of a hybrid bit 2 according to an embodiment of the present disclosure. The bit 2 may have a central axis L and a bit body 6 having a threaded section 8 on its upper end for securing the bit to a drill string (not shown). The bit 2 has a predetermined gage diameter, which may be defined by one or more of three rolling cones 10 (two of which are visible in FIG. 1), carrying cutting inserts 11, and three fixed blades 12 (two of which are visible in FIG. 1), carrying cutting elements 14, on the bit body 6. The bit body 6 may include three legs 16 to which the rolling cones 10 are rotatably mounted. Each rolling cone 10 and associated leg 16 may be positioned between adjacent blades 12 in an alternating relationship on the bit body 6. The bit 2 may include a plurality of nozzles (now shown) for directing drilling fluid toward a bottom of the wellbore in which the bit 2 may be located and around the rolling cones 10 and the fixed blades 12. It is to be appreciated that the bit 2 may have any number of rolling cone 10 cutters, and may have any number of fixed blades 12.

Figure 2:
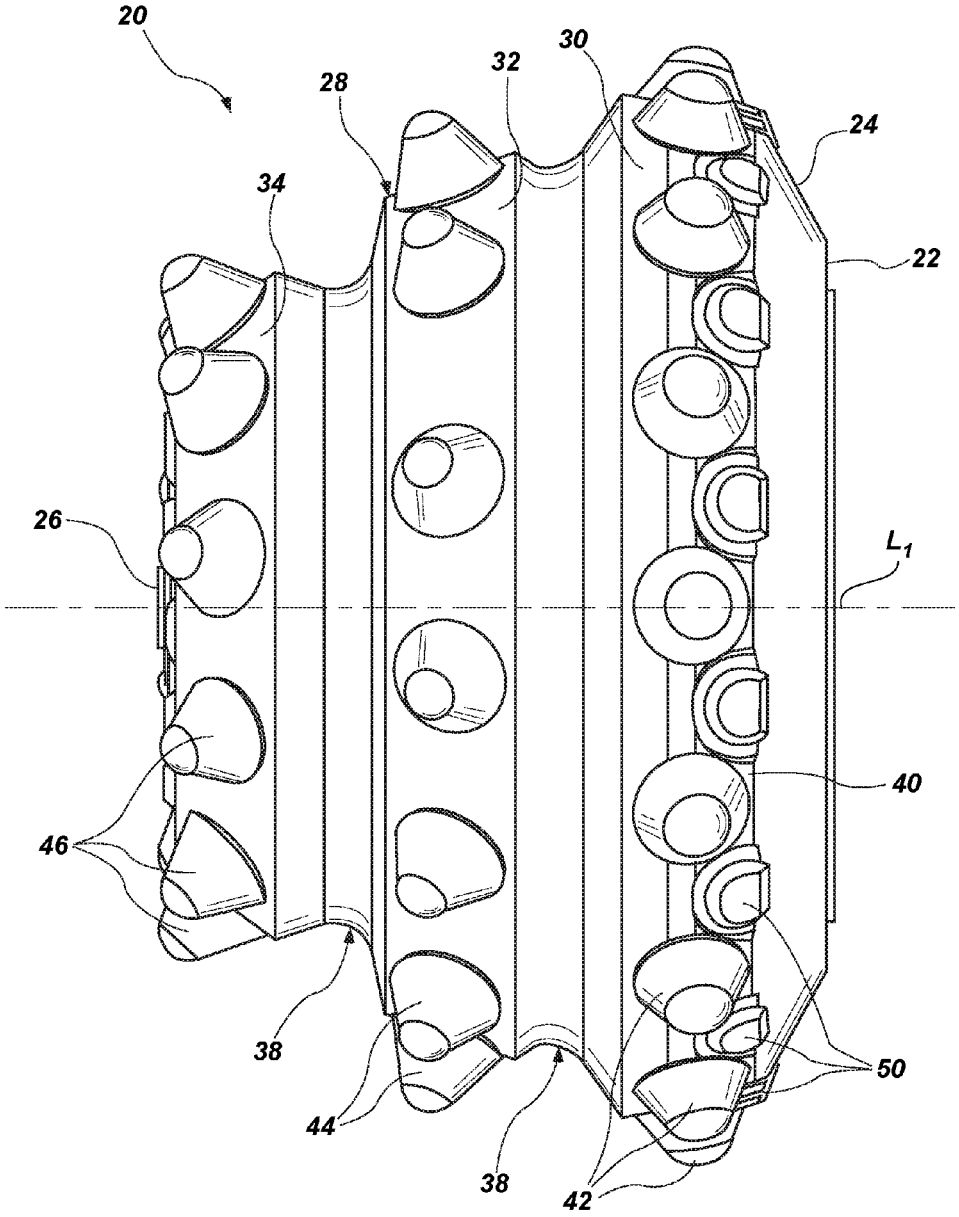
FIG. 2 illustrates a side view of a rolling cone carrying gage cutting elements, according to an embodiment of the present disclosure.

FIG. 2 illustrates a side view of a rolling cone 20, configured generally similar to the rolling cones 10 of FIG. 1, for use on an earth-boring tool. It is to be appreciated that the rolling cone 20 of FIG. 2 may be employed on a hybrid bit, such as the hybrid bit 2 shown in FIG. 1, as well as on any of the hybrid bits described in U.S. Pat. No. 9,004,198, issued on Apr. 14, 2015, to Kulkarni; and U.S. Pat. No. 8,678,111, issued Mar. 25, 2014, to Zahradnik et al.; and U.S. Patent Application Publication No. 2013/0313021 A1, published on Nov. 28, 2013, in the name of Zahradnik et al., the entire disclosure of each of which is incorporated herein by this reference. The rolling cone 20 may also be employed on a conventional rolling cone drill bit that does not include fixed blades 12, such as a tri-cone bit, a dual cone bit, or any other bit or earth-boring tool, including reamers and hole openers, employing rolling cones.

With continued reference to FIG. 2, the rolling cone 20 may include a backface 22 at a proximal end thereof. The backface 22 may be oriented perpendicular to a longitudinal axis $L_1$ of the rolling cone 20 and may be configured to be located proximate an associated leg 16 of the bit body 6 (FIG. 1). The rolling cone 20 may also include a frustoconical gage surface 24 located distally of and adjacent the backface 22. The gage surface 24 may be adapted to carry cutting elements that scrape or ream a wall of a wellbore as the rolling cone 20 rotates about the bottom of the wellbore. Extending between the gage surface 24 and a distal end 26, also termed a "nose," of the rolling cone 20 is an outer surface 28 adapted for carrying cutting inserts that gouge and/or crush formation material at the bottom of the wellbore as the rolling cone 20 rotates about the wellbore. The outer surface 28 may be generally conical in shape, as shown in FIG. 2; although, in other embodiments, the outer surface 28 may have a generally elliptical shape, a generally toroidal shape or other shape. The outer surface 28 may include a plurality of generally cylindrical or frustoconical segments 30, 32, 34, referred to herein as "lands," on and in which wear-resistant inserts, cutting inserts and/or cutting elements are mounted to the rolling cone 20. Grooves 38 may be formed in the outer surface 28 between adjacent lands 30, 32, 34. A first land 30, also termed a "heel land," may be located distally of and adjacent the gage surface 24. A second land 32 may be located distally of the heel land 30, and a third land 34 may be located distally of the second land 32. While FIG. 2 shows three lands 30, 32, 34 on the outer surface 28 of the rolling cone 20, it is to be appreciated that more or fewer than three lands may be employed. The gage surface 24 and the heel land 30 may converge in a circumferential shoulder 40. Although the shoulder 40 is shown in FIG. 2 as being an abrupt edge, it is to be appreciated that the shoulder 40 may be contoured or rounded.

The rolling cone 20 may include a plurality of cutting inserts 42, 44, 46 mounted to the lands 30, 32, 34 of the outer surface 28 of the rolling cone 20. Exposed portions of the cutting inserts 42, 44, 46 may be generally conical with rounded tips, as shown in FIG. 2, although numerous other insert shapes and designs are within the scope of the embodiments disclosed herein. By way of non-limiting example, the cutting inserts 42, 44, 46 may be shaped according to any of the inserts disclosed in U.S. Pat. No. 6,202,770, issued Mar. 20, 2001, to Jurewicz et al., the entire disclosure of which is incorporated herein by this reference. The cutting inserts 42, 44, 46 may include a plurality of heel row inserts 42 mounted in a circumferential row on the heel land 30, a plurality of second row inserts 44 mounted in a circumferential row on the second land 32, and a plurality of third row inserts 46 mounted in a circumferential row on the third land 34. While FIG. 2 shows a single row of cutting inserts 42, 44, 46 on each land 30, 32, 34, it is to be appreciated that each land 30, 32, 34 may include two or more circumferential rows of cutting inserts, a plurality of staggered cutting inserts, or no inserts at all. The heel row cutting inserts 42, the second row cutting inserts 44 and the third row cutting inserts 46 may be arranged and spaced on the outer surface 28 of the rolling cone 20 so as not to interfere with rows of cutting inserts on each of any other rolling cones employed on the earth-boring tool.

With continued reference to FIG. 2, a plurality of gage cutting elements 50 may be mounted in a circumferential row on the heel land 30. The gage cutting elements 50 and the heel row inserts 42 may be positioned in an alternating circumferential arrangement on the heel land 30, although other arrangements are within the scope of the present disclosure. Portions of the gage cutting elements 50 may extend over the shoulder 40 and into the gage surface 24 of the rolling cone 20, as discussed in more detail below. The gage cutting elements 50 may optionally be located in recesses formed in the heel land 30 and substantially surrounding the associated gage cutting element 50. As shown, the gage surface 24 may be devoid of cutting elements, except for the portions of the gage cutting elements 50 located on the heel land 30 and extending into the gage surface 24. However, in other embodiments, additional gage cutting elements may be located on the gage surface 24.

The gage cutting elements 50 may generally function to scrape or shear material from a wall of the wellbore to maintain the wellbore at a full gage diameter and prevent erosion and abrasion of the gage surface 24 of the rolling cone 20. The second row inserts 44 and the third row inserts 46 may generally function to gouge, crush and remove formation material from the bottom of the wellbore. The gage cutting elements 50 and the heel row inserts 42 may complement one another in removal of formation material at a corner junction between the wellbore wall and bottom.

Figure 3:
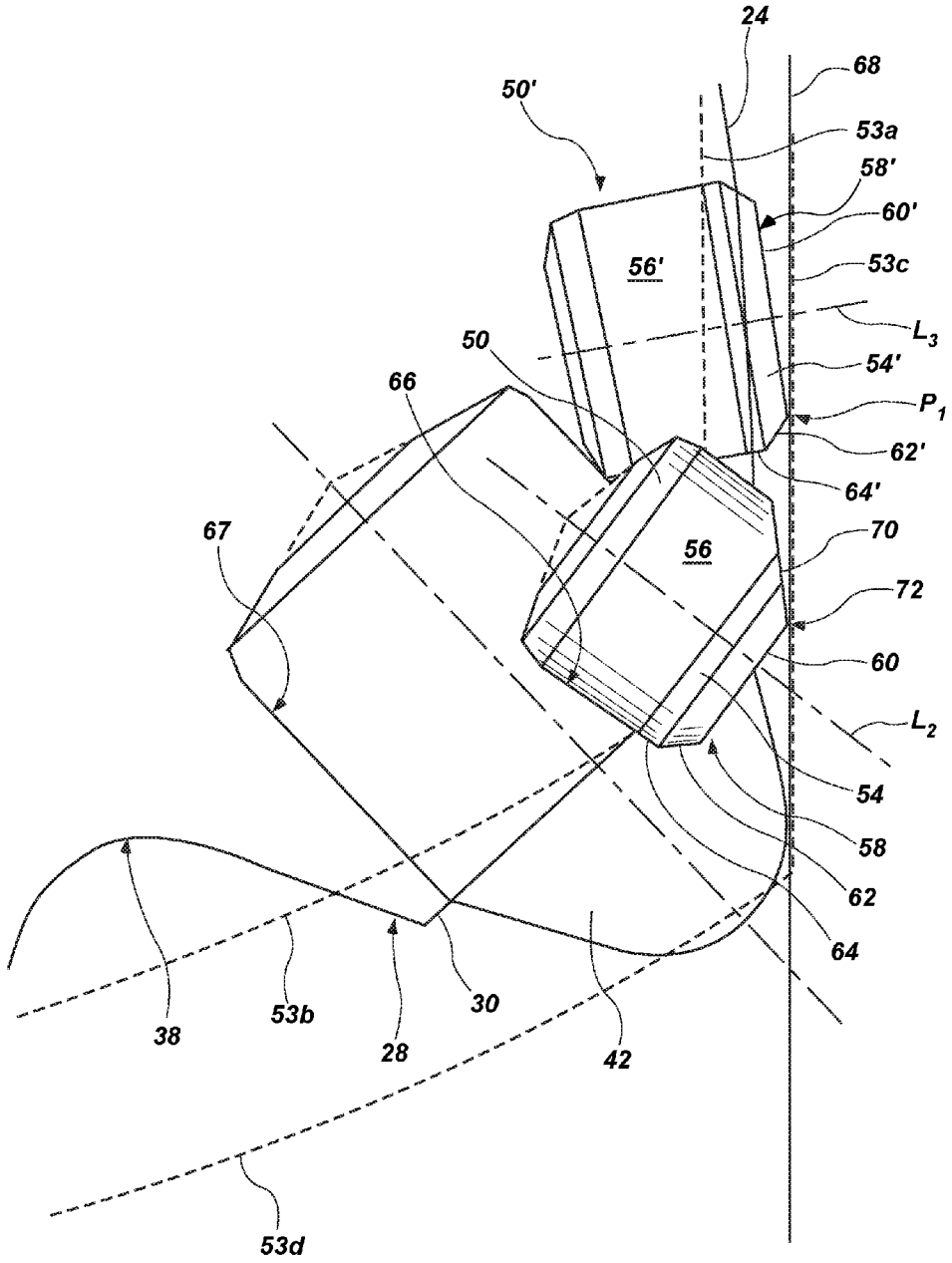
FIG. 3 illustrates a profile view of a cutting insert and a first gage cutting element located on a heel land and a second gage cutting element located on a gage surface of the rolling cone of FIG. 2.

Referring now to FIG. 3, a profile of a gage region of an earth-boring tool employing the rolling cone 20 of FIG. 2 is provided. The portion of the earth-boring tool shown in FIG. 3 may be a portion of a hybrid bit, similar to the hybrid bit 2 shown in FIG. 1. Profiles of a gage cutting element 50, a heel row insert 42, and a proximal portion of the outer surface 28 of the rolling cone 20 are shown, including the gage surface 24, the heel land 30 and a groove 38 adjacent the heel land 30. The profiles of the foregoing components are taken in a plane extending along the longitudinal axis $L_1$ of the rolling cone 20 (FIG. 2). Because, in the depicted embodiment, the gage cutting elements 50 and the heel row inserts 42 are each in respective circumferential rows about the longitudinal axis $L_1$ of the rolling cone 20, each gage cutting element 50 and each heel row insert 42 of FIG. 2 will occupy the respective profiles of the representative gage cutting element 50 and the representative heel row insert 42 of FIG. 3 as the rolling cone 20 rotates about its longitudinal axis $L_1$. Profiles of a gage region 53*a* and a shoulder region 53*b* of a fixed blade of the tool are also provided for reference, as are general cutting profiles 53*c*, 53*d* of cutting elements attached thereto.

The gage cutting element 50 may include a volume of superabrasive material 54 disposed on a substrate 56. The volume of superabrasive material 54 may comprise interbonded grains of superabrasive material such as, for example, polycrystalline diamond (PCD) comprising synthetic diamond, natural diamond, or a combination of synthetic diamond and natural diamond, or other superabrasive materials (for example, cubic boron nitride), known in the art. The volume of superabrasive material 54 is often referred to in the art as a "superabrasive table" or a "diamond table" when it comprises polycrystalline diamond.

The substrate 56 may be formed from a material that is relatively hard and resistant to wear. For example, the substrate 56 may be formed from and include a ceramic-metal composite (i.e., "cermet") material. The substrate 56 may include a cemented carbide material, such as cobalt-cemented tungsten carbide, in which tungsten carbide particles are cemented together in a metallic binder material including cobalt. Other metallic binder materials may include, for example, nickel, iron, or alloys and mixtures thereof. Alternatively, other substrate materials may be used.

The volume of superabrasive material 54 may include a front cutting face 58 having a central, planar surface 60 and a chamfer surface 62 extending between the central, planar surface 60 and a peripheral, lateral side surface 64 of the volume of superabrasive material 54. It is to be appreciated that, while the gage cutting element 50 shown in FIG. 3 has a generally cylindrical shape, other shapes are within the scope of the present disclosure. By way of non-limiting example, the gage cutting element 50, including the substrate 56 and the volume of superabrasive material 54, may have an elliptical, rectangular, triangular or tombstone shape when viewed in a plane transverse to a longitudinal axis $L_2$ of the gage cutting element 50. Additionally, while the front cutting face 58 of the volume of superabrasive material 54 is shown as having the central, planar surface 60, the front cutting face 58 may include shaped features and non-planar geometries. Moreover, while the substrate 56 is shown as being generally cylindrical, in other embodiments, the substrate 56 may have other shapes or features for facilitating insertion and retention of the gage cutting element 50 in the heel land 30 of the rolling cone 20 (FIG. 2).

With continued reference to FIG. 3, the gage cutting element 50 may be retained within a pocket 66 extending into the heel land 30 and the gage surface 24 of the rolling cone 20. The gage cutting element 50 may be press fitted into the pocket 66. In other embodiments, the gage cutting element 50 may be brazed within the pockets 66, which may accomplished with a brazing material selected to provide the gage cutting element 50 with a higher clearance from the outer surface 28 of the rolling cone 20. The gage cutting element 50 is shown in position relative to an adjacent heel row insert 42, which may be retained within a second pocket 67 in the heel land 30. Also depicted is what is termed a "gage line" 68, which represents the maximum radius (i.e., the gage), taken from the central axis L of the tool body to which the rolling cone 20 is attached, at which the heel row inserts 42 and/or the gage cutting elements 50 contact formation material as the tool body rotates within the wellbore and the rolling cone 20 rotates about its longitudinal axis $L_1$. Stated differently, the gage line 68 may be said to represent the maximum cutting radius of the at least one rolling cone 20, measured from the central axis L of the earth-boring tool. As can be seen, the gage cutting element 50 and the heel row insert 42 may each extend to the gage line 68. In this configuration, during cutting action of the rolling cone 20, the heel row insert 42 gouges and/or crushes formation material at the gage line 68, while the gage cutting element 50 scrapes, shears and/or abrades remaining formation material up the gage line 68 relative to the heel row insert 42.

A profile of a prior art gage cutting element, referred to herein as a second gage cutting element 50', which is attached strictly to the gage surface 24 of the rolling cone 20, is also depicted. The second gage cutting element 50' is depicted solely for purposes of comparison with the gage cutting element 50 of the present disclosure. The second gage cutting element 50' is configured cylindrically about longitudinal axis $L_3$ somewhat similar to that of the gage cutting element 50, and may include a volume of superabrasive material 54' disposed on a substrate 56', with the volume of superabrasive material 54' having a lateral side surface 64' and a front cutting face 58' with a central, planar surface 60' and an annular chamfer surface 62'.

Locating the gage cutting element 50 of the present disclosure primarily on the heel land 30, as opposed to strictly on the gage surface 24, provides benefits. As can be seen, the second gage cutting element 50' (located entirely on the gage surface 24 of the rolling cone 20) is coincident with the gage line 68 generally at a single point $P_1$ coinciding with a radially outer edge of the central, planar surface 60' of the front cutting face 58' of the second gage cutting element 50'. Additionally, the central, planar surface 60' of the second gage cutting element 50' is oriented at an upward acute angle α relative to the gage line 68 of the tool profile (i.e., the central, planar surface 60' faces uphole and away from the formation material of the wellbore wall during an earth-boring operation). At such an orientation, the second gage cutting element 50' primarily contacts formation material with the downhole-facing portion of the chamfer surface 62' of the volume of superabrasive material 54'. Accordingly, the chamfer surface 62' of the second gage cutting element 50' may be considered to be the effective cutting face of the second gage cutting element 50', as the cutting action becomes concentrated at the chamfer surface 62'. The angle at which the second gage cutting element 50' engages formation material may be dependent upon the angle of the downhole portion of the chamfer surface 62' relative to the wellbore wall (as analogously represented by the gage line 68). Additionally, a total surface contact area between the second gage cutting element 50' and the formation material may be dependent upon the size of the chamfer surface 62' and the angle between the chamfer surface 62' and the gage line 68. In relation to the second gage cutting element 50', a minimum clearance between the gage surface 24 of the rolling cone 20 and the gage line 68 must be maintained to prevent accumulation and compacting of formation cuttings directed from the chamfer surface 62' into a narrow downhole gap between the gage surface 24 and the gage line 68 adjacent the chamfer surface 62', as more fully described in Pessier, Rudolf C. O. et al., *Rolling Cone Bits with Novel Gauge Cutting Structure Drill Faster, More Efficiently* at 3, FIG. 9 (SPE 30473, Society of Petroleum Engineers, Inc., 1995), the entire disclosure of which is incorporated herein by this reference.

Figure 4:
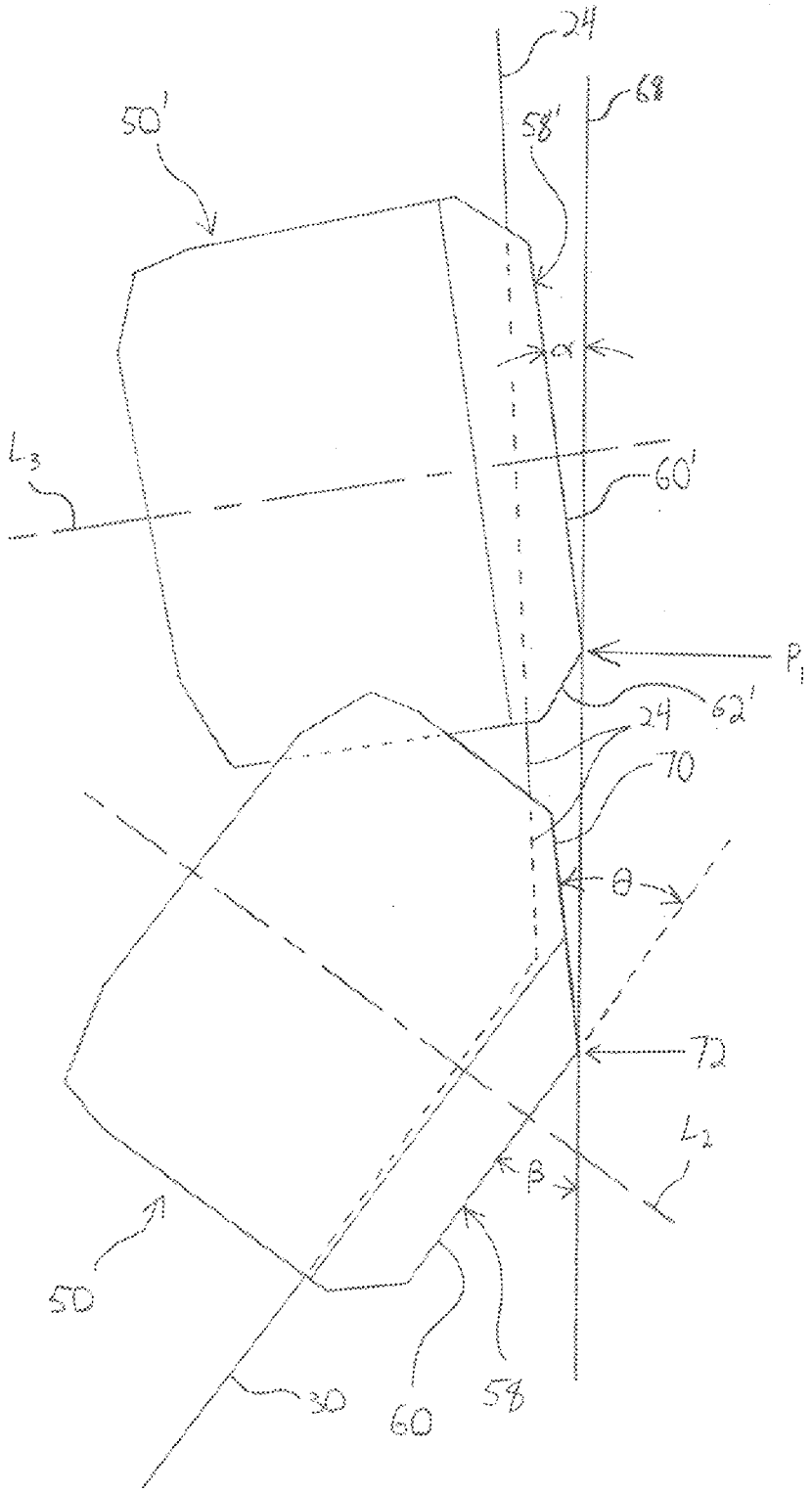
FIG. 4 is a magnified profile view of the first and second gage cutting elements shown in FIG. 3.

FIG. 4 provides a magnified view of the profiles of the gage cutting element 50 and the second gage cutting element 50' depicted in FIG. 3, and depicts the upward acute angle α of the central, planar surface 60' of the second gage cutting element 50', as well as other respective angles of associated surfaces of the gage cutting element 50 and the second gage cutting element 50', as set forth below. Thus, for a view of callouts for the angles discussed below, the reader is referred to FIG. 4, while the remainder of the subject matter is also generally shown in FIG. 3.

By locating the gage cutting element 50 primarily on the heel land 30, the central, planar surface 60 of the front cutting face 58 may be oriented at a downward acute angle β relative to the gage line 68 (i.e., the central, planar surface 60 faces downhole and into the formation material). Stated differently, the gage cutting element 50 may be located on the rolling cone 20 such that the central, planar surface 60 of the front cutting face 58 is the effective cutting face of the gage cutting element 50 (i.e., the central, planar surface 60 faces the downhole direction when the rolling cone 20 positions the front cutting face 58 at a maximum radial distance from the central axis L of the earth-boring tool).

The downward acute angle β of the central, planar surface 60 of the front cutting face 58 may be between about 5 degrees and about 50 degrees relative to the gage line 68. In other embodiments, the downward acute angle β of the central, planar surface 60 of the front cutting face 58 may be between about 10 degrees and about 30 degrees relative to the gage line 68. At the foregoing downward acute angles β, the gage cutting element 50, located on the heel land 30, engages formation material with a significantly greater percentage of the surface area of the front cutting face 58 than that of the second gage cutting element 50' located strictly on the gage surface 24 of the rolling cone 20. Accordingly, the gage cutting element 50 located on the heel land 30 is more effective at engaging and removing formation material at the maximum radius (i.e., the gage) of the wellbore, resulting in a smoother, cleaner wellbore wall, than the second gage cutting element 50' located strictly on the gage surface 24 of the rolling cone 20. The orientation of the front cutting face 58 (i.e., a downhole-facing orientation) when engaging formation material also has the beneficial effect of increasing the longitudinal magnitude, and reducing the lateral magnitude, of cutting forces on the volume of superabrasive material 54 of the gage cutting element 50, reducing the risk of crack formation and subsequent delamination of the volume of superabrasive material 54.

Moving the position of the gage cutting element 50 onto the heel land 30 also effectively moves the gage cutting element 50 down the gage line 68 of the tool profile to a position nearer the heel row insert 42, providing more collaboration between the gouging and crushing cutting action of the heel row insert 42 and the scraping, shearing and/or abrading cutting action of the gage cutting element 50. Additionally, locating the gage cutting element 50 on the heel land 30 also improves evacuation of formation cuttings from the wellbore. In particular, as the heel row insert 42 and the gage cutting element 50 engage and dislodge formation cuttings from the wall of the wellbore, a wider downhole gap (in comparison with that of the second gage cutting element 50') is provided between the gage line 68 and the cutting face 58 of the gage cutting element 50 (and between the gage line 68 and the outer surface 28 of the rolling cone 20 adjacent the cutting face 58) to receive formation cuttings emanating from the front cutting face 58. Thus, the gage cutting element 50 located primarily on the heel land 30 reduces compaction of formation cuttings such that an increased portion of these cuttings are evacuated with the drilling fluid between the gage surface 24 of the rolling cone 20 and the wall of the wellbore (as analogously represented by the gage line 68) relative to that of the second gage cutting element 50'. The presence of the second gage cutting element 50' on the gage surface 24 of the rolling cone 20 also unfavorably reduces the area between the gage surface 24 and the wellbore wall through which the cuttings may be evacuated. By locating the gage cutting element 50 on the heel land 30, an increased area is provided for formation cuttings to be evacuated between the gage surface 24 and the wellbore wall. Such a configuration further enhances evacuation of formation cuttings, as well as reduces wear on the rolling cone 20, thus increasing the efficiency and prolonging the service life of the rolling cone 20.

With continued reference to FIGS. 3 and 4, the gage cutting element 50 may also include a flat surface 70, also termed a "flat," formed on the volume of superabrasive material 54 and contiguous with the central, planar surface 60 of the front cutting face 58. The flat 70 may be oriented at an acute angle θ relative to the central, planar surface 60 of the front cutting face 58. As shown, the flat 70 may extend into the substrate 56, although, in other embodiments, the flat 70 may extend only into the volume of superabrasive material 54. The flat 70 may subsume between about 10% and about 50% of a diameter of the front cutting face 58 of the gage cutting element 50. In some embodiments (such as embodiments where the front cutting face 58 does not have a planar surface), the flat 70 may be oriented relative to a plane transverse to the longitudinal axis $L_2$ of the gage cutting element 50. In such embodiments, the flat 70 may extend at an acute angle θ of about 45 degrees from a plane transverse to the longitudinal axis $L_2$ of the gage cutting element 50. However, in other embodiments, the flat 70 may extend at an acute angle between about 65 degrees and about 25 degrees relative to the plane transverse to the longitudinal axis $L_2$ of the gage cutting element 50. In further embodiments, the flat 70 may extend at an angle between about 5 degrees and about 25 degrees from the plane transverse to the longitudinal axis $L_2$ of the gage cutting element 50. The flat 70 may be located on a side of the gage cutting element 50 that extends into the gage surface 24 of the rolling cone 20 and may taper from the front cutting face 58 of the gage cutting element 50 in a direction generally parallel with the gage surface 24 of the rolling cone 20.

Figure 5:
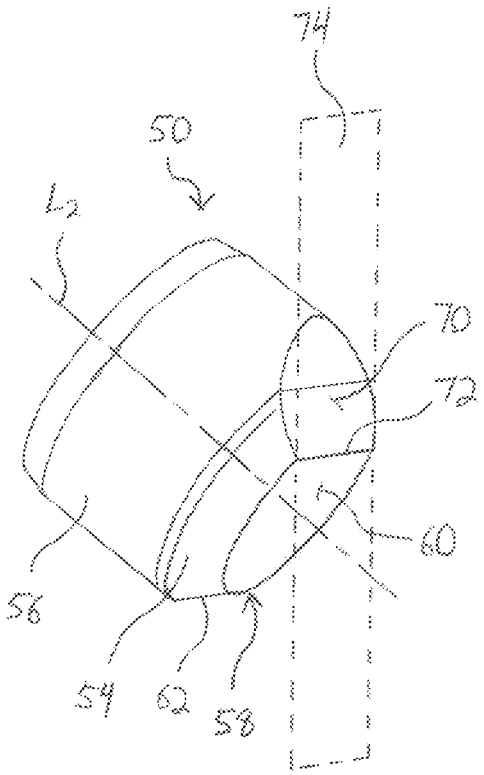
FIG. 5 is a perspective view of the first gage cutting element of FIGS. 3 and 4.

The presence of the flat 70 in the superabrasive table 54 of the gage cutting element 50 allows the location of the gage cutting element 50 on the heel land 30 to be moved proximally on the heel land 30 such that a greater portion of the gage cutting element 50 is coincident with the gage line 68. Accordingly, instead of the gage line 68 being coincident with only a peripheral edge of the central, planar surface 60' (as in the case of the second gage cutting element 50' located strictly on the gage surface 24 of the rolling cone 20), the gage line 68 is substantially coincident with an entire edge 72 between the flat 70 and the central, planar surface 60 of the gage cutting element 50 located on the heel land 30, as shown more clearly in FIG. 5. With continued reference to FIG. 5, in this manner, the presence of the flat 70 in the volume of superabrasive material 54 provides the gage cutting element 50 with a greater contact area on formation material at the gage line 68, as represented by dashed area 74, resulting in a cleaner, smoother wellbore wall.

It is to be appreciated that, in additional embodiments, the gage cutting elements 50 disclosed herein may be entirely located on the heel land 30, with no portion of some or all of the gage cutting elements 50 extending into the gage surface 24. In such embodiments, the gage cutting elements 50 may be configured to achieve the beneficial results discussed herein by adjusting the one or more of the size, clearance and orientation of the respective gage cutting elements 50.

It is also to be appreciated that the rolling cone 20 disclosed herein may be utilized to repair or retro-fit an earth-boring tool with enhanced gage cutting action. For example, an operator may remove a used, worn, damaged or outdated first rolling cone from an associated leg of the earth-boring tool and affix the rolling cone 20 disclosed herein in place of the first rolling cone.

Although the foregoing description contains many specifics, these are not to be construed as limiting the scope of the present disclosure, but merely as providing certain exemplary embodiments. Similarly, other embodiments of the disclosure may be devised that do not depart from the spirit or scope of the present disclosure. For example, features described herein with reference to one embodiment also may be provided in others of the embodiments described herein. The scope of the disclosure is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. An earth-boring tool, comprising:

a bit body; and at least one rolling cone rotatably attached to a leg of the bit body, the at least one rolling cone comprising:

a frustoconical surface proximate the leg;

an outer surface located distally of the frustoconical surface, the outer surface having a circumferential land surface adjacent the frustoconical surface;

a plurality of cutting inserts affixed to the circumferential land surface; and at least one gage cutting element affixed to the circumferential land surface, a portion of the at least one gage cutting element extending into the frustoconical surface, the at least one gage cutting element having a volume of superabrasive material disposed on a substrate, a flat surface of the volume of superabrasive material intersecting a front cutting face of the volume of superabrasive material of the at least one gage cutting element, the flat surface oriented at an acute angle relative to the front cutting face, the flat surface located on a side of the at least one gage cutting element extending into the frustoconical surface of the at least one rolling cone.

2. The earth-boring tool of claim 1, wherein the bit body is a hybrid bit body further comprising a plurality of fixed blades carrying cutting elements.

3. The earth-boring tool of claim 1, wherein the flat surface of the volume of superabrasive material of the at least one gage cutting element extends into the substrate of the at least one gage cutting element.

4. The earth-boring tool of claim 1, wherein the at least one gage cutting element is at least partially surrounded by an associated recessed surface formed in the circumferential land surface.

5. The earth-boring tool of claim 1, wherein an edge between the flat surface and the front cutting face of the at least one gage cutting element is coincident with a maximum cutting radius of the at least one rolling cone, measured from a central axis of the earth-boring tool.

6. The earth-boring tool of claim 1, wherein the frustoconical surface of the at least one rolling cone is devoid of cutting elements except for the at least one gage cutting element.

7. The earth-boring tool of claim 1, wherein the at least one gage cutting element is oriented on the at least one rolling cone such that the front cutting face of the at least one gage cutting element faces a downhole direction when the at least one rolling cone positions the front cutting face at a maximum radial distance from a central axis of the earth-boring tool.

8. The earth-boring tool of claim 7, wherein the at least one gage cutting element is oriented on the at least one rolling cone such that the front cutting face of the at least one gage cutting element is oriented at an angle between about 10 degrees and about 30 degrees from a wall of the wellbore proximate the front cutting face when the at least one rolling cone positions the front cutting face at a maximum radial distance from a central axis of the earth-boring tool.

9. The earth-boring tool of claim 1, wherein the flat surface subsumes between about 10% and about 50% of a diameter of the at least one gage cutting element at the front cutting face thereof.

10. The earth-boring tool of claim 1, wherein the flat surface is oriented at an angle between about 25 degrees and about 65 degrees from a plane transverse to a longitudinal axis of the at least one gage cutting element.

11. A rolling cone for use on an earth-boring tool, comprising:

a frustoconical surface at a proximal end of the rolling cone;

an outer surface located distally of the frustoconical surface, the outer surface having a circumferential land surface adjacent the frustoconical surface; and at least one gage cutting element affixed to the circumferential land surface, a portion of the at least one gage cutting element extending into the frustoconical surface, the at least one gage cutting element having a volume of superabrasive material disposed on a substrate, a flat surface of the volume of superabrasive material intersecting a central, planar surface of a front cutting face of the volume of superabrasive material of the at least one gage cutting element the flat surface oriented at an acute angle relative to the central, planar surface, the flat surface located on a side of the at least one gage cutting element extending into the frustoconical surface of the rolling cone.

12. The rolling cone of claim 11, wherein the outer surface is generally conical or generally toroidal in shape.

13. The rolling cone of claim 11, wherein an edge between the flat surface and the central, planar surface of the volume of superabrasive material is coincident with a maximum cutting radius of the rolling cone when the rolling cone is disposed on an earth-boring tool.

14. The rolling cone of claim 11, wherein the at least one gage cutting element is oriented on the rolling cone such that the front cutting face of the at least one gage cutting element faces a downhole direction when the rolling cone is attached to an earth-boring tool and the rolling cone positions the front cutting face at a maximum radial distance from a central axis of the earth-boring tool.

15. The rolling cone of claim 14, wherein the at least one gage cutting element is oriented on the rolling cone such that the front cutting face of the at least one gage cutting element is oriented at an angle between about 10 degrees and about 30 degrees from a wall of the wellbore proximate the front cutting face when the rolling cone is attached to the earth-boring tool and the rolling cone positions the front cutting face at the maximum radial distance from the central axis of the earth-boring tool.

16. The rolling cone of claim 11, wherein the flat surface subsumes between about 10% and about 50% of a diameter of the volume of superabrasive material at the front cutting face of the at least one gage cutting element.

17. The rolling cone of claim 16, wherein the flat surface is oriented at an angle between about 25 degrees and about 65 degrees from a plane transverse to a longitudinal axis of the at least one gage cutting element.

18. The rolling cone of claim 11, wherein the flat surface is oriented at an angle between about 25 degrees and about 65 degrees from a plane transverse to a longitudinal axis of the at least one gage cutting element.

19. The rolling cone of claim 18, wherein the flat surface is oriented generally parallel with the frustoconical surface of the rolling cone.

20. A method of assembling an earth-boring tool, comprising:

removing a first rolling cone from a leg of a bit body of an earth-boring tool; and affixing a second rolling cone to the leg, the second rolling cone comprising:

a frustoconical surface proximate the leg;

an outer surface located distally of the frustoconical surface, the outer surface having a circumferential land surface adjacent the frustoconical surface, a plurality of cutting inserts affixed to the circumferential land surface, at least one gage cutting element affixed to the circumferential land surface, a portion of the at least one gage cutting element extending into the frustoconical surface, the gage cutting element having a volume of superabrasive material disposed on a substrate, a flat surface of the volume of superabrasive material being contiguous with a front cutting face of the volume of superabrasive material, the flat surface oriented at an acute angle relative to the front cutting face, the flat surface located on a side of the at least one gage cutting element extending into the frustoconical surface of the second rolling cone.

* * * * *